United States Patent [19]

Laverick et al.

[11] 4,133,594

[45] Jan. 9, 1979

[54] SELF-LOCKING CONNECTOR

[75] Inventors: Eric W. Laverick, Enfield, Conn.; Clyde E. Wesp, Hillsdale, N.J.

[73] Assignee: HI-G, Incorporated, Windsor Locks, Conn.

[21] Appl. No.: 804,447

[22] Filed: Jun. 7, 1977

[51] Int. Cl.[2] ..... H01R 17/04

[52] U.S. Cl. ..... 339/95 D; 339/177 E; 403/105

[58] Field of Search ..... 339/95 R, 95 D, 177 R, 339/177 E; 24/90 E, 110; 403/105

[56] References Cited

U.S. PATENT DOCUMENTS 2,748,363 5/1956 Despard ..... 339/95 D 2,779,828 1/1957 Despard ..... 339/95 D

*Primary Examiner*—Neil Abrams

*Attorney, Agent, or Firm*—Donald J. Hayes

[57] ABSTRACT

A connector is disclosed which features a bifurcated contact providing a pair of contact legs enveloped within an insulating body or housing having a conductor entry opening registering with the contact legs. The housing includes beveled cam shoulders adjacent its opening and which cooperate with the contact legs to automatically apply a predetermined conductor locking force upon inserting the conductor into the housing between the contact legs and which increase the locking force in response to a conductor withdrawal force being applied.

8 Claims, 4 Drawing Figures

SELF-LOCKING CONNECTOR

This invention generally relates to electrical connectors and particularly concerns connectors of the type which are self-locking once the conductor is inserted into position in the connector.

An object of this invention is to provide a new and improved electrical connector of a self-locking type which not only applies a predetermined locking force on the conductor but is particularly suited to increase that locking force upon the application of a force tending to withdraw the conductor.

Another object of this invention is to provide such a connector which is quick and easy to install and is designed for low cost manufacture in mass production quantities.

Other objects will be in part obvious and in part pointed out more in detail hereinafter.

A better understanding of the invention will be obtained from the following detailed description and the accompanying drawing of an illustrative application of the invention.

Figure 1:
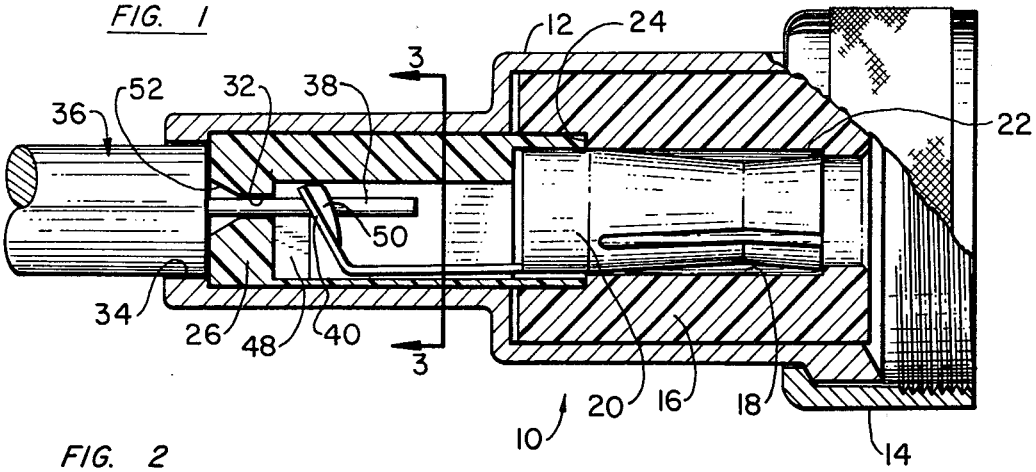
FIG. 1 is a side view, partly broken away and partly in section, showing a connector incorporating this invention.

Referring to the drawing in detail, an electrical connector 10 is illustrated having an outer connector body 12 mounted on a threaded coupling 14 to be connected to any suitable use device, not shown. Within an enlarged diameter end of the connector body 12 is an insulating sleeve 16 having a central passage 18 within which a tubular fitting 20 is received. Fitting 20 is formed of a conductive material for use with any suitable male connector, not shown, and is seated against a shoulder 22 formed by a reduced diameter end of the central passage 18 in sleeve 16. The opposite end of the sleeve 16 has an enlarged diameter, coaxially aligned opening forming a shoulder 24 against which is seated an insulating hollow connector housing 26 extending into a reduced diameter end of the connector body 12.

During assembly, the outer connector body 12 is inserted through the coupling 14, and the insulating connector housing 26 is fitted within the reduced end of body 12. The fitting 20 is then inserted into the end of housing 26, and the sleeve 16 is assembled within the connector body 12 with shoulder 24 abutting the end of housing 26 and the sleeve 16 in surrounding relation to the fitting 20.

In the specifically illustrated embodiment, the insulating connector housing 26 is formed with a contact chamber 28 of generally rectangular cross section (FIG. 3) which extends forwardly from the rear opening within housing 26 receiving the tubular fitting 20. An extension strip or base 30 of resilient conductive material is integrally formed with the tubular fitting 20 to project along the bottom of the contact chamber 28. The connector housing 26 is shown having an end wall with a conductor entry opening 32 communicating with contact chamber 28 and end opening 34 of the outer connector body 12, the openings 32 and 34 being in coaxially aligned relation to one another. Both the sleeve 16 and housing 26 are formed of a suitable insulating material to insulate the tubular fitting 20 and its base 30 from the outer grounding body of the connector 10.

A coaxial cable 36 is illustrated as having an exposed center conductor 38 which is to be connected to a contact end of fitting 20. The contact end is shown as having a bifurcated configuration forming a pair of contact legs 40, 42 defining a slot 44 therebetween with the upper end of slot 44 registering with the conductor entry opening 32 wherein the contact legs 40, 42 are angularly offset relative to base 30 to project toward the entry opening 32.

By virtue of the above described construction, the insulating connector housing 26 not only insulates the contact end of fitting 20 but mechanically supports its contact end and provides a self-locking action on center conductor 38 of coaxial cable 36. More specifically, opposed internal cam shoulders 46, 48 are formed between contact chamber 28 and the conductor entry opening 32 with the shoulders 46, 48 being beveled to provide a constricted throat for the contact chamber 28 which is longitudinally tapered toward its conductor entry opening 32.

The contact legs 40, 42 are pivotable about a junction formed between the base 30 and the angularly offset contact legs 40, 42. The contact legs will be understood to be preloaded due to the resiliency of its spring material in a ready position toward one another and toward the conductor entry opening 32 before penetration of conductor 38 between the contact legs 40, 42. Each of the contact legs 40, 42 additionally have a foot 50 (FIG. 1) bent in the direction of conductor entry movement and which serves to assist conductor penetration between the legs 40, 42.

Upon inserting the center conductor 38 into a flared conductor guide 52 in the outside face of the insulating connector housing 26, the conductor 38, which will be understood to be of a diameter greater than the slot width between the contact legs 40, 42, strikes the contact legs and pushes them back. The legs accordingly, pivot about their junction with their base 30 to separate the legs 40, 42 and permit axial passage of the center conductor 38 through the legs. When the conductor entry movement is completed, the resiliency of the spring material of the contact legs 40, 42 returns the legs into bearing engagement against the cam shoulders 46, 48 with the legs 40, 42 in locking position gripping the center conductor of the coaxial cable 36.

Accordingly, the cam shoulders 46, 48 cooperate with the contact legs 40, 42 in locking position to deflect the contact legs inwardly and thereby wedge the legs 40, 42 between their respective cam shoulders 46, 48 and the center conductor 38. In the specific illustrated embodiment, the included angle between the contact legs 40 and 42 in locking position is illustrated as preferably being about 90 degrees.

Figure 2:
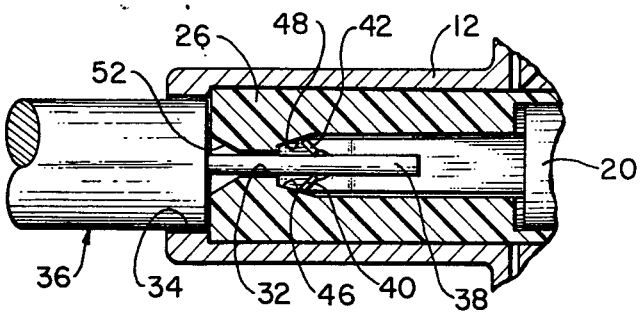
FIG. 2 is a top view, partly in section and partly broken away, of the connector of FIG. 1.
Figure 3:
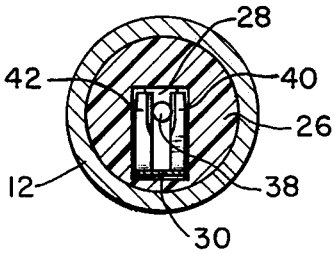
FIG. 3 is a section view taken generally along line 3—3 of FIG. 1.
Figure 4:
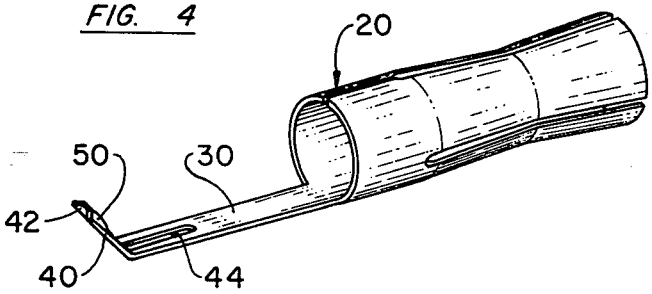
FIG. 4 is an isometric view showing a fitting which may be used in the application of this invention.

With the contact legs 40, 42 in locking position as shown in FIGS. 1–3, the contact legs 40, 42 additionally cooperate with the cam shoulders 46, 48 to increase the center conductor locking force in response to force tending to withdraw the center conductor 38 from connector 10. The described connector will effectively resist any such backward conductor movement until the force of such movement equals the shear strength of the cross section of the conductor wire, causing the contact legs 40, 42 to penetrate the material of the center conductor wire.

As will be apparent to persons skilled in the art, various modifications, adaptations and variations of the foregoing specific disclosure can be made without departing from the teachings of the present invention.

We claim:

1. An electrical conductor connector comprising an insulating body having a conductor entry opening at one end of the body and beveled cam shoulders adjacent the opening forming a passage which tapers towards said entry opening, and means including a strip of conductive material having a bifurcated end forming a pair of contact legs defining a slot therebetween registering with the opening, the contact legs being movable into a locking position in engagement with said cam shoulders to apply a predetermined conductor locking force upon conductor entry between the contact legs, the contact legs in locking position cooperating with said cam shoulders with outer portions of said contact legs being slidable along said cam shoulders and being urged towards each other to increase said locking force upon application of a force tending to effect conductor withdrawal.

2. The connector of claim 1 further including a coaxial cable center conductor axially inserted through the entry opening at said one end of the body and projecting through the slot between the contact legs.

3. The connector of claim 2 wherein the contact legs are normally engaged with said cam shoulders and preloaded before conductor entry into the body in a ready position with the width of the slot being of reduced size relative to the diameter of the conductor.

4. The connector of claim 2 wherein the contact legs prevent conductor withdrawal until its tensioning force equals the shear strength of the conductor material causing penetration thereof by the contact legs.

5. The connector of claim 1 wherein the strip of conductive material includes a base mounted in fixed relation to the insulating body, wherein a junction is formed between the base and the contact legs, the contact legs being pivotable relative to said junction into said locking position during conductor entry.

6. The connector of claim 1 wherein each of the contact legs have a foot bent in the direction of conductor entry movement serving to assist conductor penetration between the contact legs.

7. The connector of claim 1 wherein the contact legs in locking position are angularly disposed to the axis of conductor movement, the included angle between the contact legs being about 90 degrees.

8. An electrical conductor connector comprising an insulating body having a conductor entry opening at one end of the body and beveled cam shoulders adjacent the opening, and means including a strip of conductive spring material having a base mounted in fixed relation to the insulating body and a bifurcated end forming a pair of contact legs, the contact legs being integrally formed in angularly offset relation to the base and defining a slot between the legs registering with the opening, a junction being formed between the base and the contact legs, the contact legs being bent at an angle relative to the base to project toward the entry opening in the body, the contact legs being movable into a locking position in engagement with said cam shoulders to apply a predetermined conductor locking force upon conductor entry between the contact legs, the contact legs each being normally engaged with their respective cam shoulder and preloaded due to the resiliency of the spring material in a ready position toward the other of the contact legs and toward the entry opening before conductor penetration between the contact legs, the contact legs being pivotable about said junction responsive to penetration of the contact legs during conductor entry to separate the same from said ready position to permit conductor passage therebetween, the contact legs assuming said locking position upon completion of the conductor entry movement and cooperating with said cam shoulders to increase said locking force upon application of a force tending to effect conductor withdrawal.

* * * * *